US005241840A

United States Patent [19]

Kennedy

[11] Patent Number: 5,241,840

[45] Date of Patent: Sep. 7, 1993

[54] REFRIGERATOR WITH SPINE FIN EVAPORATOR

[75] Inventor: Adam C. Kennedy, Louisville, Ky.

[73] Assignee: General Electric Company, Louisville, Ky.

[21] Appl. No.: 933,247

[22] Filed: Aug. 21, 1992

Related U.S. Application Data

[62] Division of Ser. No. 813,487, Dec. 26, 1991.

[51] Int. Cl.[5] ..... F25B 39/02

[52] U.S. Cl. ..... 62/515; 165/184

[58] Field of Search ..... 62/515; 165/184

[56] References Cited

U.S. PATENT DOCUMENTS

| | | | |
|---|---|---|---|
| 1,942,211 | 1/1924 | Hartwig | 62/515 |
| 1,960,305 | 5/1934 | Emmons et al. | 165/184 |
| 2,070,539 | 2/1937 | Muhleisen | 257/262 |
| 2,277,462 | 3/1942 | Spofford | 62/515 |
| 2,529,545 | 11/1950 | Edwards | 257/262.2 |
| 2,621,903 | 12/1952 | Cohler | 62/515 |
| 3,362,058 | 1/1968 | Morris et al. | 29/157.3 |
| 4,286,655 | 9/1981 | Trojani | 165/184 |
| 4,742,869 | 5/1988 | Nakao et al. | 165/115 |
| 5,085,272 | 2/1992 | Venables, IV | 165/184 |

FOREIGN PATENT DOCUMENTS

| | | | |
|---|---|---|---|
| 692164 | 10/1930 | France | 165/184 |
| 0014050 | 2/1979 | Japan | 165/184 |
| 480513 | 2/1938 | United Kingdom | 165/184 |

*Primary Examiner*—Ronald C. Capossela

*Attorney, Agent, or Firm*—Radford M. Reams; H. Neil Houser

[57] ABSTRACT

A refrigerator has a compartment to be refrigerated and a refrigerant evaporator normally operable at frost producing temperatures to refrigerate the compartment. The evaporator includes an elongated tube to receive refrigerant with an elongated spine fin ribbon of heat exchange material including an elongated base wound in an open spiral about and in intimate heat exchange contact with the tube. A continuous series of fingers project outwardly of the tube along each edge of the base and the distal ends of the fingers are bent to extend generally perpendicular to the root portions of the fingers.

3 Claims, 4 Drawing Sheets

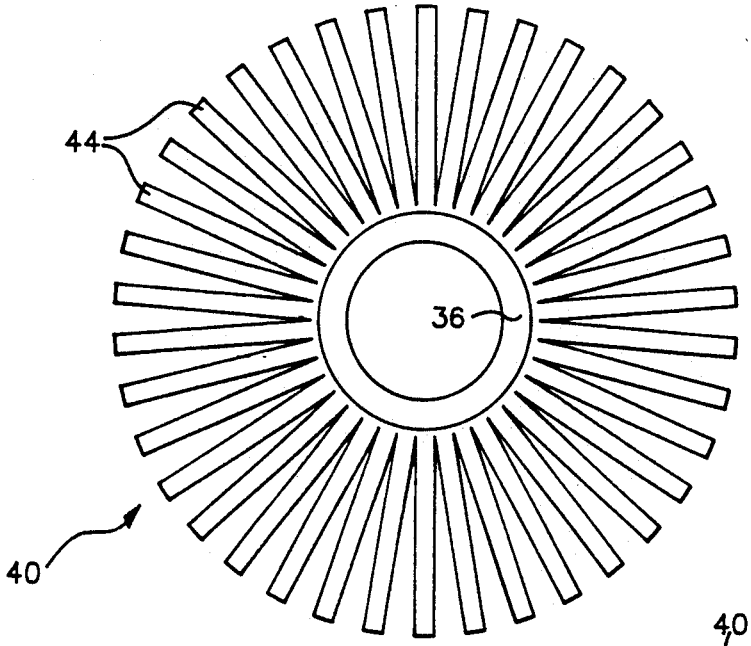
FIG. 2
FIG. 3
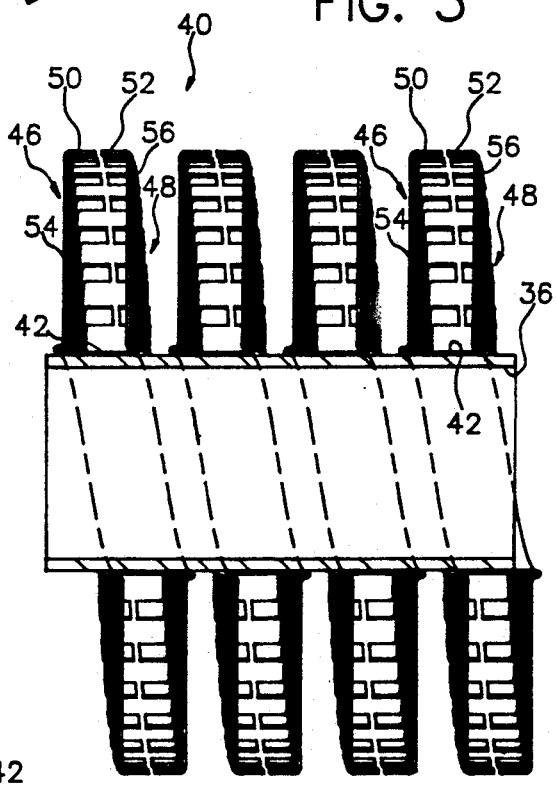
FIG. 4
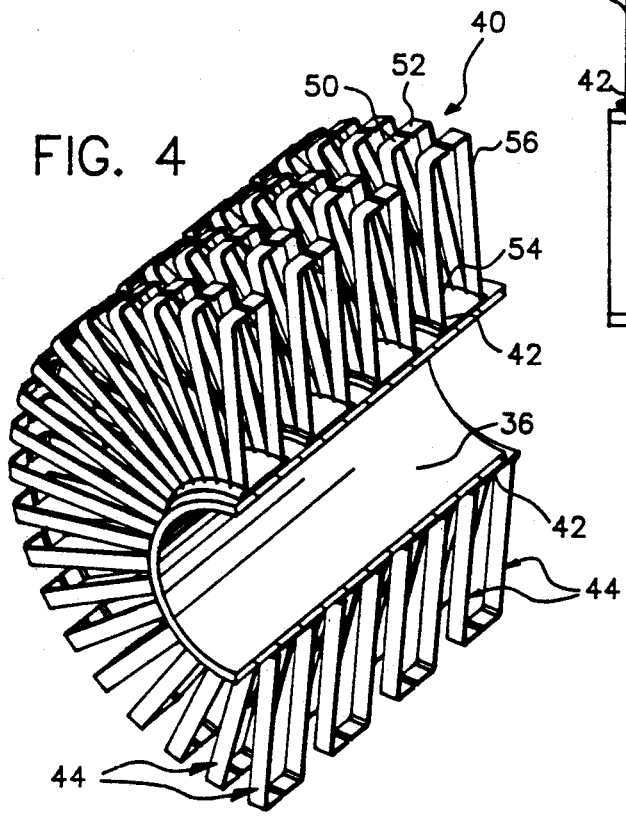

REFRIGERATOR WITH SPINE FIN EVAPORATOR

CROSS REFERENCE TO RELATED APPLICATIONS

This application is a division of copending application Ser. No. 07/813,487, filed Dec. 26, 1991, entitled Refrigerator With Spine Fin Evaporator and assigned to the same assignee as this application.

BACKGROUND OF THE INVENTION

For many years spine fin tubing has been used in heat exchange structures for air conditioners. In such heat exchangers the spine fin ribbon is wrapped about the evaporator tubing in a very compact fashion; that is, the spine fin ribbon is wound so that adjacent passes of ribbon are in contact and the fingers or spines are very closely spaced. With such a construction the spines or fingers provide a very large total surface area for heat transfer.

Despite the successful use of spine fin tubing in air conditioners for many years, such heat exchange structures were not used in refrigerator evaporators. It has been the belief of many experienced practitioners that spine fin materials are not suitable for use in refrigerator evaporators. One basis for the belief was that the frost build up in a refrigerator evaporator quickly would render the spine fin ineffective as a heat transfer structure. In addition, it was believed that spine fin structures, as used in air conditioners, were too delicate to withstand the handling involved in manufacturing and installing refrigerator evaporators. On the other hand it was believed that, if the size of the spines were increased sufficiently to withstand the rigors of manufacturing, then the evaporator would not have sufficient heat exchange capacity to be effective with the stringent size limitations normally imposed upon such evaporators.

Co-pending U.S. Pat. No. 5,067,322 of David G. Beers and assigned to General Electric Company, assignee of the present application, discloses a refrigerator evaporator incorporating a ribbon of spine fin material wound about the outer periphery of the evaporator tubing with a series of fingers extending perpendicularly outward of the tube along each edge of the ribbon, and is incorporated herein by reference.

However, it is desirable to further optimize the heat transfer between the spine fin material and the air passing over the evaporator.

Accordingly, it is an object of this invention to provide an improved refrigerator with an evaporator incorporating a spine fin heat exchange structure of improved heat transfer capability.

It is another object of the present invention to provide an improved structure in which the distal end portions of the spine fin fingers extend perpendicularly of the direction of air flow across the elongated evaporator tubing.

It is still another object of this invention to provide such an improved structure in which a spine fin ribbon has a base wrapped about the evaporator tubing in an open spiral with fingers extending outwardly of said evaporator tubing along each edge of the base and with the distal ends of the fingers bent to extend generally perpendicular to the root portions of the fins.

It is yet another object of this invention to provide such an improved structure in which the finger distal ends all extend in the same direction.

It is yet another object of this invention to provide such an improved structure in which the finger distal ends overlie the corresponding portions of the spine fin base.

It is still another object of this invention to provide such an improved structure in which the finger distal ends extend axially of the tubing away from the corresponding portion of the spine fin base.

Further objects and advantages of the present invention will be apparent from the following description and features of novelty which characterize the invention will be pointed out in the claims attached to and forming a part of this specification.

SUMMARY OF THE INVENTION

In accordance with one form of this invention a refrigerator has a compartment to be refrigerated and an evaporator normally operated at frost producing temperature to refrigerate the compartment. The evaporator includes elongated tubing to carry refrigerant and an elongated spine fin ribbon wrapped in intimate heat transfer contact about the tubing in an open spiral configuration. The ribbon is formed with a base having a substantially continuous series of fingers projecting outwardly of the tubing along each lateral edge of the base. The distal ends of the fingers are bent to extend generally perpendicular to the root portions of the fingers and lie in a direction perpendicular to the direction of air flow over the evaporator tubing.

BRIEF DESCRIPTION OF THE DRAWINGS

FIG. 2 is a cross-sectional view taken laterally of the evaporator tubing incorporated in FIG. 1;

FIG. 3 is a fragmentary cross-sectional view taken longitudinally of the tube of FIG. 1;

FIG. 4 is a fragmentary perspective view of the tube of FIG. 1, partly broken away;

DESCRIPTION OF THE PREFERRED EMBODIMENTS

Figure 1:
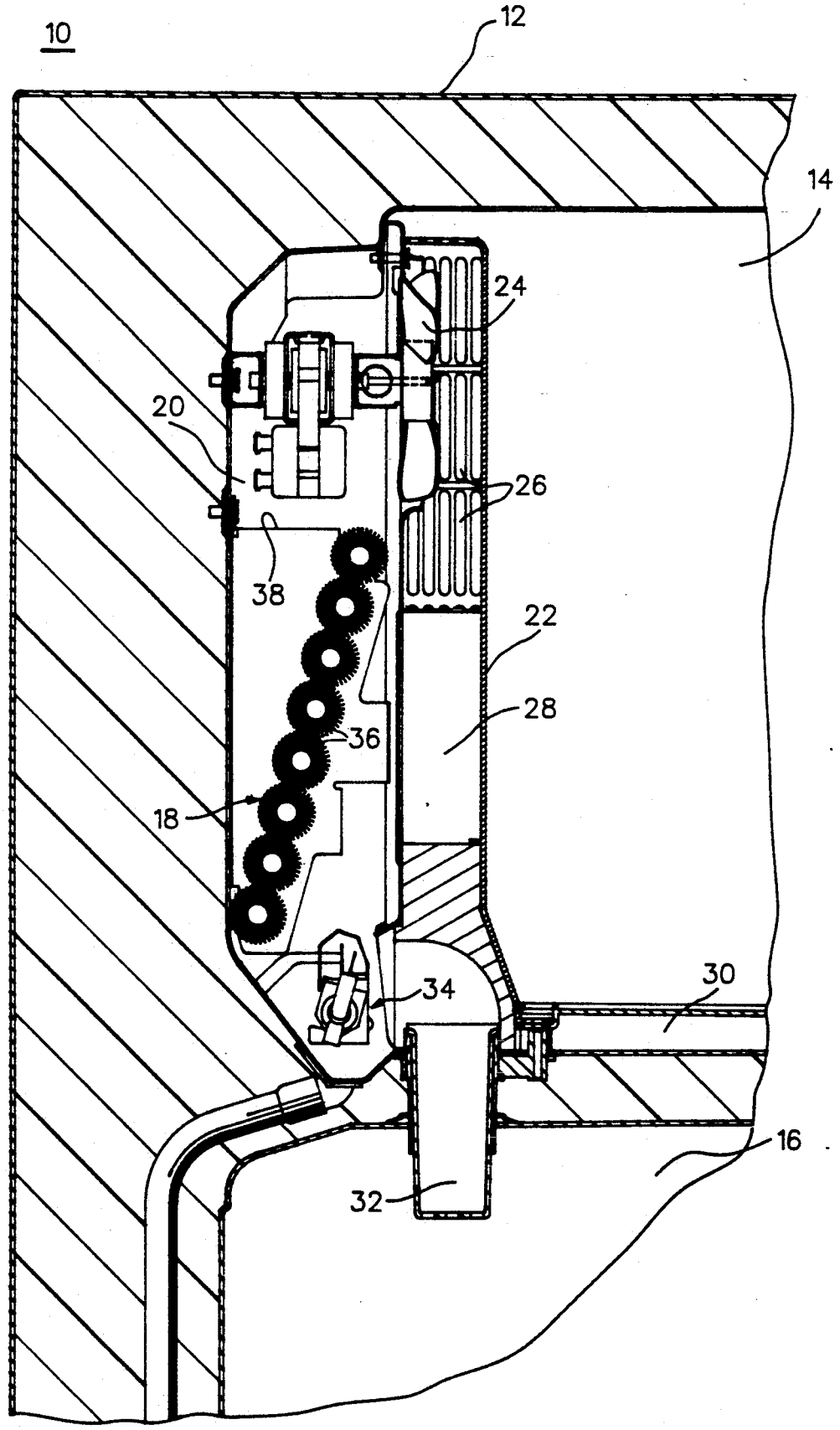
FIG. 1 is a fragmentary cross-sectional side elevation view of a refrigerator incorporating one embodiment of the present invention.
Figure 5:
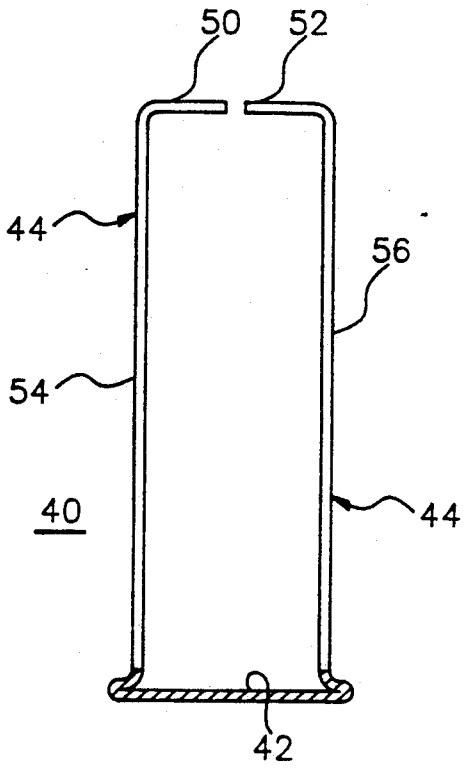
FIG. 5 is a cross-sectional view of the spine fin ribbon incorporated in the evaporator tubing assembly of FIGS. 2–4.

Referring now to FIG. 1, a refrigerator 10 includes an outer cabinet 12 containing a freezer compartment 14 and fresh food compartment 16. The freezer compartment 14 is maintained at sub-freezing temperatures and the fresh food compartment 16 at above freezing, food preserving temperatures by circulating air through these compartments and over an evaporator 18 positioned in a vertically disposed evaporator chamber 20 positioned behind the freezer compartment 14 and separated from it by wall structure 22. More specifically, a fan 24 positioned in the upper portion of the evaporator chamber or compartment 20 discharges air through openings 26 in the wall 22 into the freezer compartment 14 and through a passage, partially shown at 28, to the fresh food compartment 16. The fan also draws air from within the freezer compartment 14 and fresh food compartment 16 back into the evaporator compartment 20 and over the evaporator. The return air from the freezer compartment flows through a passage partially shown at 30 while the air returned from the fresh food compartment flows through passage 32. The freezer compartment 14 is maintained below freezing while the fresh food compartment 16 is maintained above freezing by an appropriate division of the air discharged from the evaporator compartment 20, with the majority of the air going to the freezer compartment 14 and a smaller portion of the air going to the fresh food compartment 16.

In order to maintain the freezer compartment 14 at sub-freezing temperatures, it is necessary that the evaporator 18 operate at below freezing temperatures, with the result that moisture contained in the return air flowing through the evaporator chamber 20 collects on the outer surfaces of the evaporator in the form of frost. Periodically this accumulated frost is removed from the evaporator surfaces by energizing a heater 34 positioned in radiant and convection heating relationship with the evaporator surfaces.

Refrigerator evaporators transfer heat from the air passing over the outside of the evaporator surface to the refrigerant flowing through the inside of the evaporator so as to cool the air. A typical refrigerator evaporator consists essentially of an elongated tubing or tube carrying refrigerant which is bent or formed into either a serpentine or a spiral configuration in order to fit in a more confined space and, thus, take up less room in the refrigerated compartments of a refrigerator. In order to enhance the heat transfer characteristic of the evaporator it is well known to provide some kind of fins extending outwardly from the tube to increase the surface area for transfer. With refrigerator evaporators, particularly those which provide cooling for freezing compartments, it is necessary for the evaporator structure to provide effective heat transfer even though a considerable body of frost has built up around the evaporator tubing. To this end, the greater the space provided between adjacent fins or adjacent rows of fins of a spine fin structure the longer effective air flow over the evaporator will take place. On the other hand, larger fin spacings reduce the number of fins and the total available heat transfer surface area. Thus, it is advantageous to enhance the effectiveness of heat transfer between the air and the fins.

In the illustrative evaporator 18, a tube 36 is formed and disposed in a fashion well known in the art. That is, the tube 36 is bent in the form of serpentine to provide a plurality of elongated horizontal conduit passes disposed in a vertical spaced arrangement connected by return bends. The overall layout of the evaporator 18 is a generally rectangular construction with the various elongated passes of the tube 36 supported in spaced relationship on opposed frame members, one of which is shown at 38, at opposite sides of the evaporator 18. The frame members 38 mount the evaporator 18 in a generally vertical position within the evaporator chamber compartment 20 but slightly angled with respect to the vertical to more fully expose the horizontal passes of the tube 36 to the return air flowing upwardly through the evaporator compartment 20. With this arrangement the air flows perpendicularly across the elongated section of evaporator tubing.

The radiant heater 34 is periodically energized to warm the evaporator surfaces to defrosting temperatures. This heater conveniently may be of the type disclosed in co-pending U.S. patent application Ser. No. 07/593,749 of David G. Beers et al, assigned to General Electric Company, assignee of the present invention.

As best seen in FIGS. 2, 3 and 4, the evaporator 18 includes an elongated spine fin ribbon 40 wound or wrapped about the outer surface of tube 36 in an open spiral configuration. That is, each pass (one circumferential circuit around the tube) of the ribbon 40 is spaced apart from the longitudinally adjacent passes of the ribbon. More specifically, the ribbon includes an elongated base 42 and a plurality of spines or fingers 44. The fingers 44 are arranged in rows 46 and 48 along the lateral edges of the base 42. Each of the rows 46 and 48 is formed of a substantially continuous series of fingers 44. That is the fingers are formed adjacent to each other without significant spacings between them where they join the base 42. When wrapped around the tube 36, as shown in FIGS. 2–4, the fingers extend outwardly from the outer surface of the tube 36 adjacent the lateral edges of the ribbon base 42 and, preferably, they are disposed generally perpendicular to the outer surface tube 36.

The distal end portion of each finger is bent generally perpendicular to the root portion of the finger and thus is disposed generally perpendicular to the direction of the flow of air passing over the evaporator as result of the operation of fan 24. Viewing FIG. 4, it will be seen that the distal end portions 50 of the fingers 44 in row 46 are bent generally perpendicularly to the right of the root portion 54 while the distal end portions of fingers 44 in row 48 are bent generally perpendicularly to the left of the root portion 56. This results in the end portions overlying the ribbon base 42. This provides a compact construction and enables the ribbon to be wound in a tight spiral, that is with minimal space along the tubing between adjacent passes of ribbon.

Preferably, the end portions of the fingers are bent substantially perpendicularly to the corresponding root portions of the fingers. Thus, the end portions extend generally perpendicular to the basic direction of flow of return air flowing over the evaporator. However, it will be understood that the fin ends do not have to be bent exactly perpendicularly and that some fins and fin ends may be distorted as a result of the handling needed to form an evaporator and to mount it in a refrigerator.

When the evaporator tube and ribbon are fully assembled or formed, the bent fin end portions lie in an annular cylinder which surrounds and has the same axis as the tube. It will be understood that an annular cylinder is a hollow cylinder having a cross-section which is in the form of an annular.

Figure 6:
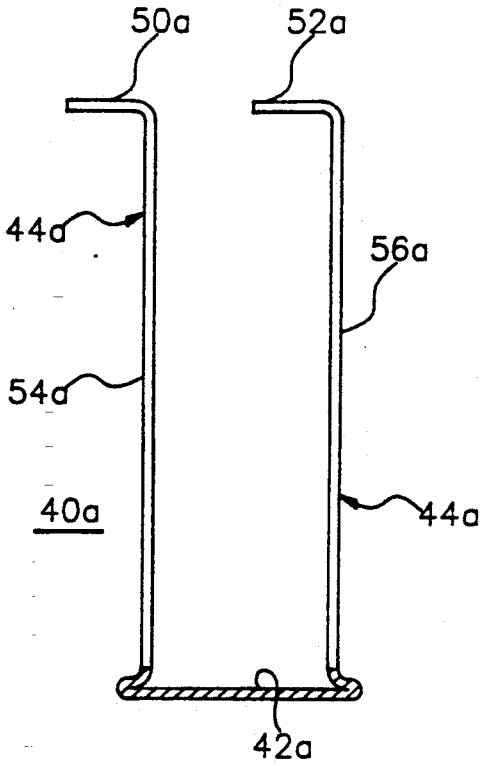
FIG. 6 is a cross-sectional view of another form of spine fin ribbon useful in the invention.
Figure 7:
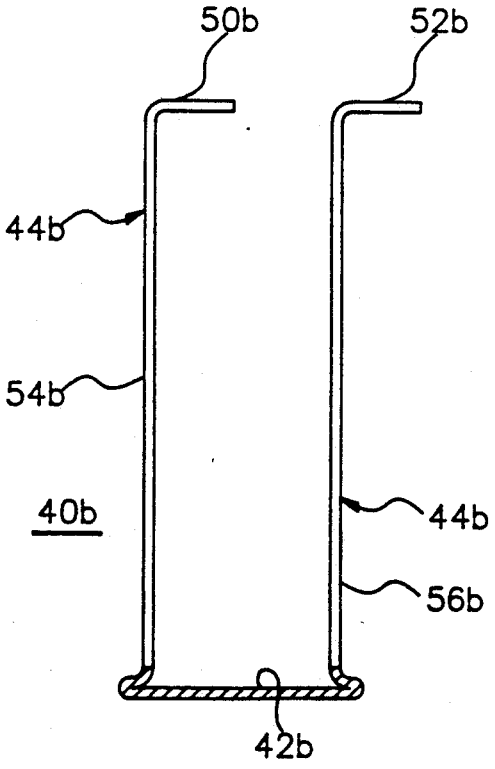
FIG. 7 is a cross-sectional view of yet another form of spine fin ribbon useful in the invention.
Figure 8:
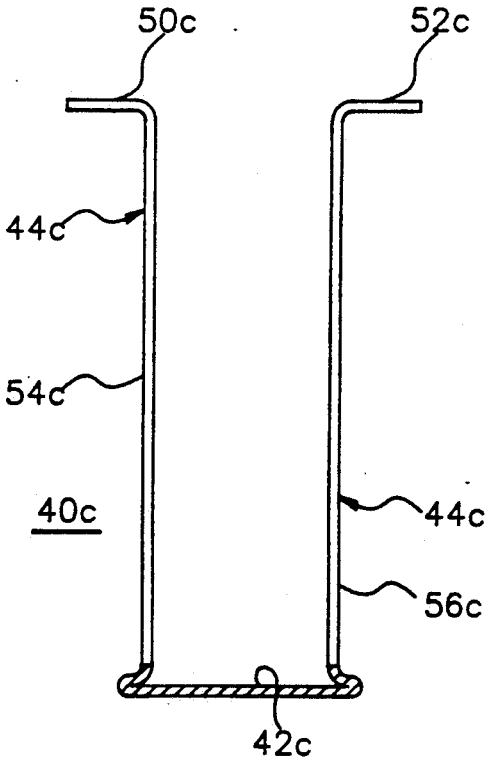
FIG. 8 is a cross-sectional view of still another form of spine fin ribbon useful in the invention.

Different configurations of ribbon finger distal end portion arrangements are possible within the scope of the invention in order to customize the evaporator tubing assembly to the operating characteristics of the particular refrigerator. Additional illustrative configurations of the spine fin ribbon are shown in FIG's 6–8, inclusive with like portions being identified with corresponding reference numerals but with the addition of letters a, b and c to distinguish the particular configurations. In FIG. 6 all the distal end portion 50*a* and 52*a* are bent to extend to the left (as seen in the FIG. 6) so that end portions 52*a* extend over the base 42*a* of the ribbon 40. In FIG. 7 the distal end portions are arranged in the opposite configuration than in FIG. 6, that is, the end portions 50*b* and 52*b* extend to the right (as seen in FIG. 7). With this configuration, end portions 50*b* overlap base 42*b* and end portions 52*b* extend outwardly of the corresponding edge of the base 42*b*. In FIG. 8 the distal ends 50*c* of fingers 44*c* in row 46*c* extend to the left while the end portions 52*c* of fingers 44*c* in row 48*c* extend to the outwardly of the corresponding edge of the ribbon base 42*c*. This positions both the base and the distal end portions perpendicular to the direction of the air flow and open to contact by the air but requires that the ribbon be wound with a wider spacing to assure that the end portions of adjacent passes of ribbon do not overlap.

Figure 9:
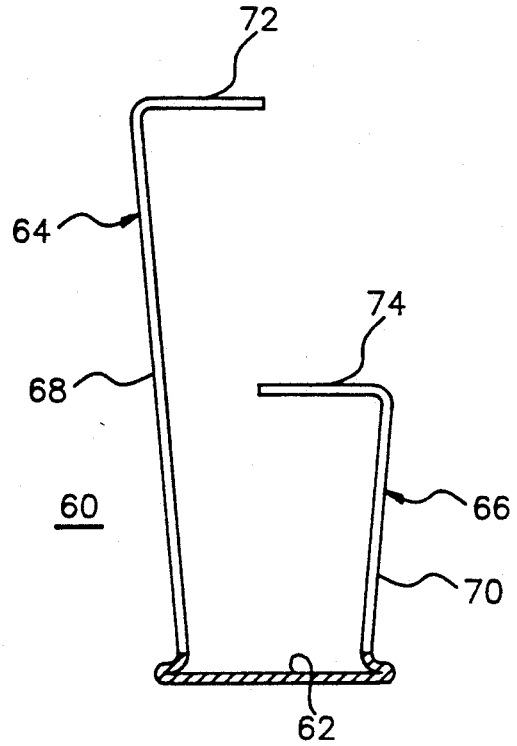
FIG. 9 is a cross-sectional view of another form of spine fin ribbon useful in the invention.
Figure 10:
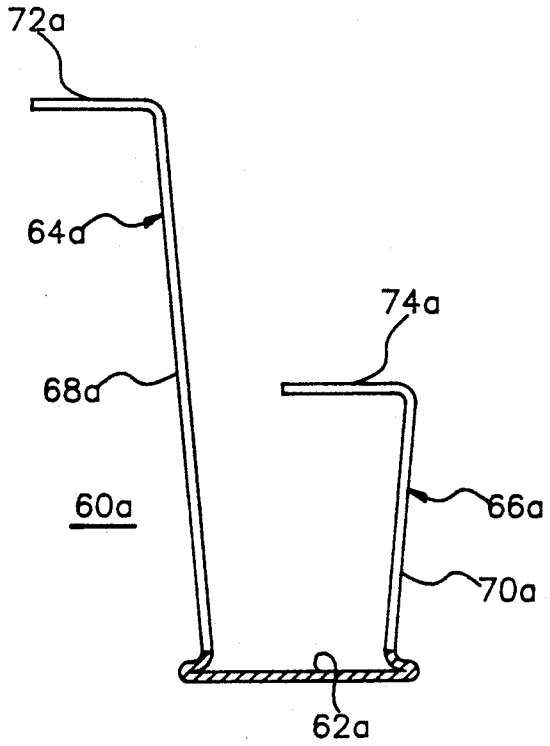
FIG. 10 is a cross-sectional view of still another form of spine fin ribbon useful in the invention.
Figure 11:
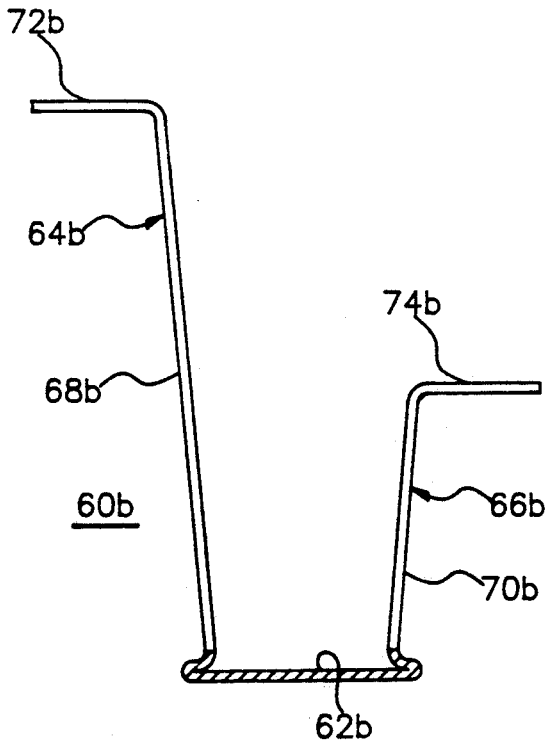
FIG. 11 is a cross-sectional view of yet another form of spine fin ribbon useful in the invention.
Figure 12:
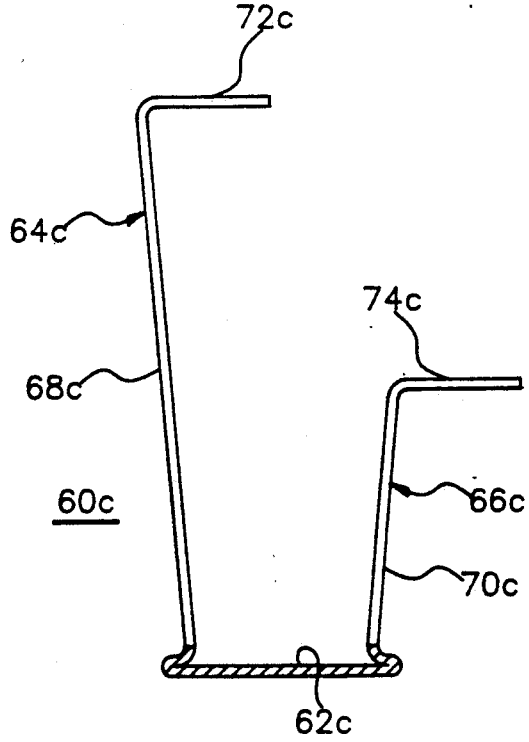
FIG. 12 is a cross-sectional view of another form of spine fin ribbon useful in the invention.

FIG's 9–12, inclusive illustrate additional forms of ribbon which are useful in forming spine fin evaporators incorporating the present invention. Referring particularly to FIG. 9, a ribbon 60 includes an elongated base 62 and a plurality of fingers 64 and 66 arranged in rows extending outwardly from the opposite sides of the base 62. The fingers in each row are formed as a substantially continuous series of fingers, with successive fingers being formed adjacent to each other without significant spacings between them where they join the base 62. When wrapped around a tube the fingers extend outwardly of the tube but are canted or slanted slightly from the perpendicular away from the base, as illustrated in FIG. 9. The root portions 68 of the fingers 64 are longer than the root portions 70 of the fingers 66. The distal end portions 72 of the fingers 64 are bent substantially at right angles to the right, as seen in FIG. 9, while the distal end portions 74 of the fingers 66 are bent to the left. The distal end portions are long enough to extend substantially across the base 62 in overlapping fashion. In the additional ribbon forms illustrated in FIG's 10–12, like components are identified with like reference numerals, but with a, b, and c subscripts, respectively, to distinguish between the different configurations. In FIG. 10 both the distal end portions 72*a* and 74*a* are bent to extend to the right so that the closer end portions 74*a* are positioned over the base 62*a* and the more remote end portions 72*a* project away from the base. In FIG. 12 all the end portions 72*c* and 74*c* are bent to extend to the left so that the closer end portions 74*c* project away from the base 62*c* and the more remote end portions 72*c* overlie the base. In FIG. 11 all of the end portions 72*b* and 74*b* are bent outwardly so that they project away from the base 62*b*.

Referring to FIG's 9–12, inclusive, the configurations of FIG's 9, 10 and 12 provide the most compact wrap, that is, adjacent passes of ribbon can be wound very close together, and the resulting composite evaporator tubing is resistant to damage during handling. The configuration of FIG. 11 is easier to manufacture, however, the ribbon cannot be wrapped as compactly. It will be understood that the invention is not limited by the particular configurations shown . For example, in each of FIG's 9–12, the left hand root portions are longer than the right hand portions. The reverse also can be the case, that is, the left hand root portions can be shorter than the right hand portions.

While there has been shown and described what is presently considered to be the preferred embodiments of the present invention, it is to be understood that the invention is not limited thereto, and it is intended in the appended claims to cover all such changes and modifications as fall within the true spirit and scope of invention.

What is claimed is:

1. A refrigerator having at least one compartment to be refrigerated and a refrigerant evaporator normally operable to refrigerate said at least one compartment; said evaporator including an elongated evaporator tube to receive refrigerant and an elongated ribbon of heat transfer material; said ribbon including an elongated base wound in an open spiral about said tube and in intimate heat transfer relationship therewith and a continuous series of fingers formed along both edges of said base; each of said fingers including a root portion extending generally perpendicularly outward from said tubing and a distal end portion bent with respect to said root portion of that finger so that distal end portions 11*e* in an annular cylinder spaced about said tube; and said root portions of said fingers formed along one edge of said base being longer than said root portions of said fingers formed along the other edge of said base.

2. A refrigerator as set forth in claim 1 wherein; said distal end portion of each of said fingers is bent substantially perpendicular to the corresponding root portion.

3. A refrigerator as set forth in claim 1, wherein: said tube is formed with a plurality of elongated sections extending in a generally parallel configuration; further including; means to cause air to flow across said tube in a direction generally perpendicular of said elongated tubing sections and wherein said finger distal end portions extend generally perpendicularly of the direction of air flow.

* * * * *